US006427497B1

(12) United States Patent
Mossberg, Jr. et al.

(10) Patent No.: US 6,427,497 B1
(45) Date of Patent: Aug. 6, 2002

(54) WALL-MOUNTED LOCKING SYSTEM FOR FIREARMS

(75) Inventors: A. Iver Mossberg, Jr., Hamden; Brian F. Klanica, Cheshire, both of CT (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 0 days.

(21) Appl. No.: 09/542,395

(22) Filed: Apr. 4, 2000

Related U.S. Application Data

(60) Provisional application No. 60/128,743, filed on Apr. 12, 1999.

(51) Int. Cl.[7] ..... E05B 73/00

(52) U.S. Cl. ..... 70/18; 70/14; 70/58; 42/70.11; 211/4; 211/8; 211/64

(58) Field of Search ..... 70/14, 18, 57, 70/58–60; 42/70.01, 70.06, 70.11, 14, 44, 106; 211/4, 8, 64; 248/316.5, 316.8

(56) References Cited

U.S. PATENT DOCUMENTS

| | | | | | |
|---|---|---|---|---|---|
| 2,765,107 | A | * | 10/1956 | Browning | 224/2 |
| 3,018,576 | A | * | 1/1962 | Riechers | 42/70.11 |
| 3,353,728 | A | * | 11/1967 | Freed | 224/1 |
| 3,634,963 | A | * | 1/1972 | Hermann | 70/14 X |
| 3,774,333 | A | * | 11/1973 | Reynolds | 70/18 X |
| 3,802,612 | A | * | 4/1974 | Smith | 211/64 X |
| 4,018,339 | A | * | 4/1977 | Pritz | 211/8 |
| 4,271,969 | A | * | 6/1981 | Gnesa | 211/64 |
| 4,395,837 | A | * | 8/1983 | Durnal | 42/70.11 |
| 4,654,992 | A | * | 4/1987 | Lavergne | 42/70.01 |
| 4,870,771 | A | * | 10/1989 | McClellan | 42/106 X |
| 4,912,867 | A | * | 4/1990 | Dukes, Jr. | 42/70.11 |
| 4,936,531 | A | * | 6/1990 | Bauser | 211/64 X |
| 4,999,940 | A | * | 3/1991 | Madden | 42/70.11 |
| 5,020,259 | A | * | 6/1991 | Mossberg | 42/70.11 |
| 5,022,534 | A | * | 6/1991 | Briggs | 211/64 X |
| 5,038,508 | A | * | 8/1991 | Brown | 42/70.11 |
| 5,044,106 | A | * | 9/1991 | Slocum | 42/70.11 |
| 5,048,212 | A | * | 9/1991 | Mossberg | 42/70.11 |
| 5,138,786 | A | | 8/1992 | Fischer | 42/70.11 |
| 5,339,966 | A | * | 8/1994 | Bastiaans | 211/4 |
| 5,503,276 | A | * | 4/1996 | Pierce | 211/64 |
| 5,520,291 | A | | 5/1996 | Graham | 211/4 |
| 5,524,772 | A | * | 6/1996 | Simmons | 211/4 |
| 5,560,497 | A | * | 10/1996 | Mulvihill, Jr. | 211/4 |
| 5,605,002 | A | * | 2/1997 | Carey | 42/106 X |
| 5,621,996 | A | * | 4/1997 | Mowl, Jr. | 42/70.11 X |
| 5,669,252 | A | * | 9/1997 | Bentley | 70/14 |
| 5,680,723 | A | * | 10/1997 | Ruiz | 42/70.11 |
| 5,934,000 | A | * | 8/1999 | Hayes, Sr. | 42/70.11 X |
| 5,979,846 | A | * | 11/1999 | Fluhr | 211/64 X |

* cited by examiner

*Primary Examiner*—Suzanne Dino Barrett
(74) *Attorney, Agent, or Firm*—Holland & Bonzagni, P.C.; John A. Kramer, Esq.

(57) ABSTRACT

A wall-mounted locking system for firearms comprises a wall-mounted base plate having hinged primary and secondary latch doors. A breech hook is connected to the base plate. The primary latch door carries a locking mechanism, which is dimensioned to pass through a hole or cut-out provided in the secondary latch door. Additionally, a barrel ring or muzzle hook is wall mounted above the base plate. A firearm is held against the base plate via the breech hook, which engages the firearm's ejection port and prevents the firearm from being loaded with ammunition. The barrel ring or muzzle hook prevents the firearm's barrel from being moved laterally. The firearm is secured via closing the latch doors and locking the lock.

32 Claims, 3 Drawing Sheets

WALL-MOUNTED LOCKING SYSTEM FOR FIREARMS

This application claims priority from a Provisional Application, Serial No. 60/128,743, filed Apr. 12, 1999.

FIELD OF THE INVENTION

The present invention relates to firearms, and, more particularly, to devices for securing firearms.

BACKGROUND OF THE INVENTION

Because firearms are valuable, and potentially dangerous when in the wrong hands, many devices have been proposed over the years for securing firearms or otherwise limiting unauthorized access thereto. Many of these devices, e.g., gun safes and electronic firearm safety systems, are cumbersome and/or expensive. Simpler alternatives, like the ubiquitous locking trigger guard, are effective for their intended purpose, but do not prevent the firearm from being spirited away or loaded with ammunition.

U.S. Pat. No. 5,138,786 to Fischer attempts to solve these problems by providing a locking, wall-mounted gun enclosure. The enclosure is generally tube-like (i.e., it is longitudinally hollow with top and bottom openings), and comprises a U-shaped housing with a door. A push-button combination lock is affixed to the door, which has upper and lower extension flaps for partially covering the enclosure's top and bottom openings when the door is closed. To secure a firearm, the door is opened, the firearm is placed inside, the door is closed, and the combination lock is locked. The firearm extends through the enclosure, and is prevented from being vertically removed from the enclosure by the extension flaps.

The gun enclosure disclosed in Fischer suffers from certain drawbacks, the main one being that the enclosure is very large and bulky. More specifically, because the gun is only secured about its mid-section (from the stock to past the trigger guard), the enclosure has to be relatively long so as to support the firearm and to prevent the gun from being used as a lever to pry the enclosure off the wall. Also, to accommodate the lock and the extension flaps, which have to be fairly wide to be strong enough to resist tampering, the enclosure likewise has to be rather wide. This makes the enclosure difficult to mount, expensive, and unattractive. Additionally, a goodly portion of the firearm is covered (detracting from the firearm's appearance), and because the firearm's trigger guard rests against the lower extension flap, the trigger guard is prone to being scratched and damaged.

Accordingly, it is a primary object of the present invention to provide an economical wall-mounted locking system for firearms that prevents unauthorized use of the firearm, and that prevents the firearm from being removed from a chosen location.

Another primary object is to provide a wall-mounted locking system for firearms that has a small footprint, and that displays the firearm in an attractive manner.

A still further object of the present invention is to provide a wall-mounted locking system for firearms wherein the firearm cannot be loaded with ammunition when secured.

SUMMARY OF THE INVENTION

A wall-mounted locking system is disclosed for economically, attractively, and securely holding firearms. A first preferred embodiment of the locking system comprises an enclosure or "box" having a wall-mounted base plate with a breech hook and hinged primary and secondary latch doors. The primary latch door carries a locking mechanism, which is dimensioned to pass through a hole or cut-out provided in the secondary latch door. Additionally, a barrel ring is mounted to the wall above the base plate.

To secure a firearm, a barrel of the firearm is inserted through the barrel ring, and the firearm is positioned next to the base plate so that the breech hook engages the firearm's ejection port (breech). This holds the firearm in place against the base plate, and prevents the firearm from being loaded with ammunition. The primary and secondary latch doors are then swung closed so that the locking mechanism passes through the cutout, enclosing the firearm, and the locking mechanism is locked. The breech hook prevents the firearm from being vertically removed from the enclosure, and the barrel ring prevents the firearm from being wrenched from the base plate.

Other preferred embodiments of the locking system replace the barrel ring with a muzzle hook, have different latch door configurations, and provide enclosures for multiple firearms.

BRIEF DESCRIPTION OF THE DRAWINGS

These and other features, aspects, and advantages of the present invention will become better understood with respect to the following description, appended claims, and accompanying drawings, in which:

DETAILED DESCRIPTION OF THE PREFERRED EMBODIMENTS

Figure 1:
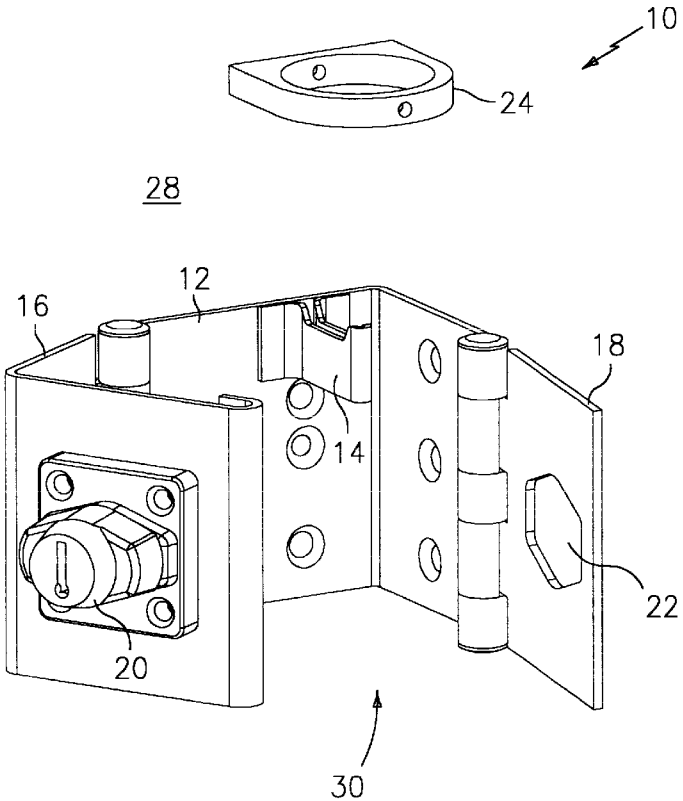
FIG. 1 is a perspective view of a first preferred embodiment of a wall-mounted locking system for firearms according to the present invention.
Figure 2:
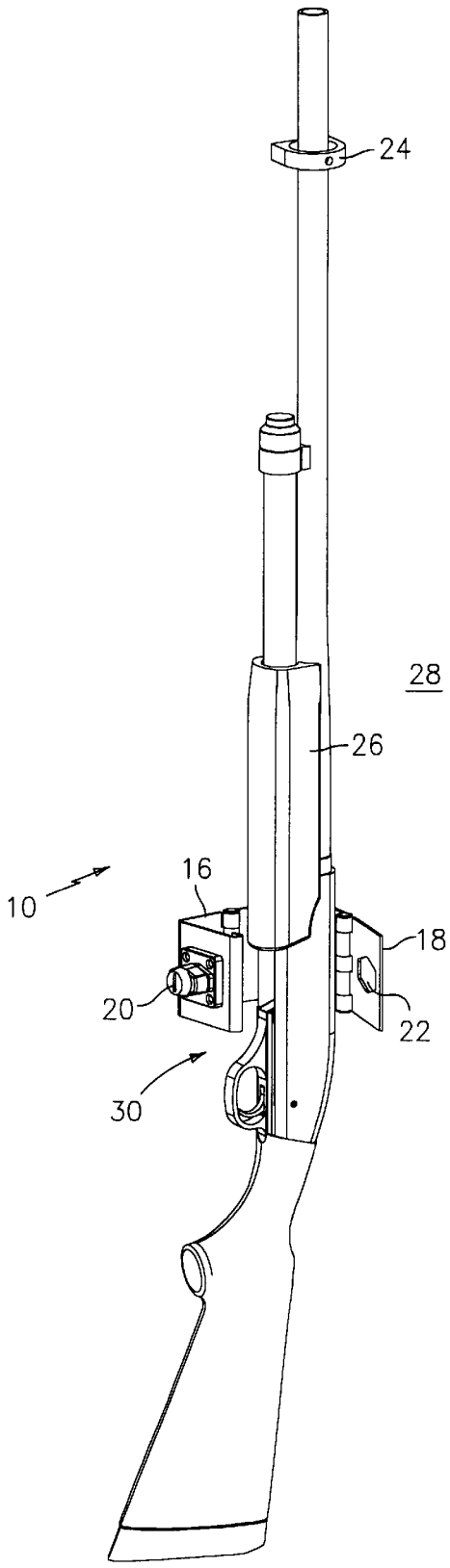
FIG. 2 is a perspective view of a firearm being held by the firearm locking system prior to primary and secondary latch doors of the locking system being closed.
Figure 3:
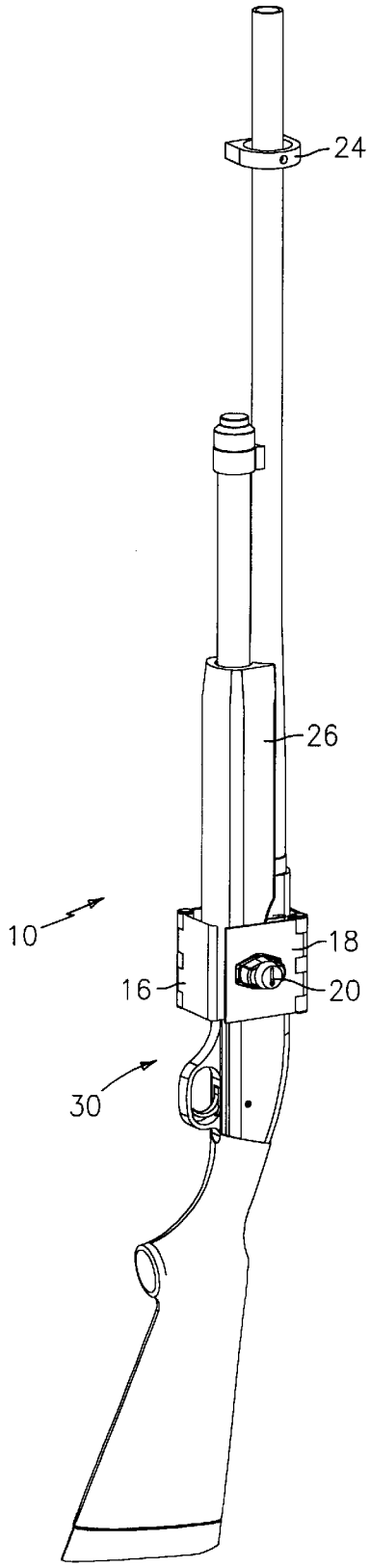
FIG. 3 is a perspective view of the firearm being held by the firearm locking system subsequent to the primary and secondary latch doors of the locking system being closed.

Turning now to FIGS. 1–3, a first preferred embodiment of a wall-mounted locking system or device 10 for firearms, according to the present invention, will now be given. The locking system 10 comprises a wall-mounted base plate 12 having a breech hook 14 and primary and secondary latch doors 16, 18. The primary latch door 16 has a lock 20, which is dimensioned to pass through a hole or cut-out 22 provided in the secondary latch door 18. Additionally, a barrel ring 24 is wall mounted above the base plate 12. A firearm 26 is held in the locking system 10 via the barrel ring 24 and the breech hook 14, and is secured via closing the latch doors 16, 18 and locking the lock 20.

Applicants' firearm locking system is marketed by the Assignee of this invention, O.F. Mossberg & Sons, Inc. of North Haven, Conn.

The locking system 10 is used to secure the shotgun or rifle-type firearm 26 by locking that firearm within a metal enclosure or "box" 30, which has been previously mounted to a wall 28. The enclosure 30 comprises the generally L-shaped base plate 12 and its two hinged doors: the primary latch door 16 and the secondary latch door 18. These latch doors 16, 18 not only facilitate mounting the enclosure 30 to the wall, but also make it easy to secure the firearm within the created enclosure. The lock or locking mechanism 20 (illustrated in FIGS. 1–3 as a key lock) is attached to the primary latch door 16. The lock 20 is dimensioned to pass through the cutout or hole 22, which is provided on the secondary latch door 18.

The breech hook 14 lies in the interior of the enclosure 30, and is attached to the base plate 12. This hook 14 fits into the ejection port and chamber (i.e., the breech not shown) of the secured rifle/shotgun 26 (see FIGS. 2 and 3). It blocks the chamber and thereby prevents someone from loading the firearm with ammunition. The breech hook 14, while extending into the ejection port, also limits the amount that the firearm 26 may be moved up and down (in the vertical direction of FIGS. 2 and 3), and prevents the firearm from being removed vertically downwards through the enclosure 30.

The locking system 10 further comprises the barrel ring 24. The barrel ring 24 is a round eyelet or hook that is mounted to the same wall surface 28 as the enclosure 30. The barrel ring 24 serves as a second restraint. It limits the amount that the firearm's barrel can be manipulated, and thus prevents the barrel from being used as a lever to pry the firearm 26 out of the enclosure 30, or to pry the enclosure 30 off the wall 28.

Once the enclosure 30 and barrel ring 24 are mounted to the wall 28, the firearm 26 may be secured therein. To do so, the firearm's barrel is inserted through the barrel ring 24, and the body of the firearm 26 is placed and positioned in the enclosure 30 so that the breech hook 14 extends into the firearm's ejection port and chamber. Then, the primary latch door 16 is swung closed. Next, the secondary latch door 18 is closed over the primary latch door 16, whereupon the front face of the lock 20 (on the door 16) protrudes through the hole or cut-out 22. The locking mechanism is then activated, firmly securing the firearm within the enclosure 30.

As should be appreciated, the breech hook 14 and the barrel ring 24 act in unison to limit the movement of the firearm. This enables the enclosure 30 to be relatively small in size and to have a small footprint. More specifically, it is only necessary that the enclosure 30 surround the portion of the firearm proximate its breech. Furthermore, as mentioned above, because the breech hook 14 engages and fills the firearm's ejection port and chamber, the firearm cannot be loaded with ammunition when in the enclosure 30. This is in contrast to other firearm safety systems, wherein it may still be possible to load and discharge the firearm.

The exact configuration of the lock 20 is not important. In fact, as should be appreciated by those of ordinary skill in the art, many different locking mechanisms could be provided without departing from the spirit and scope of the invention. For example, with the key lock 20 shown in FIGS. 1–3, a key is used to position the lock either horizontally (allowing the secondary door to be opened) or vertically (preventing the secondary door from being opened). Alternatively, a hasp (not shown) could be affixed to the primary door in place of the lock 20, and the doors could be secured via a standard padlock or other similar type lock (not shown).

Figure 4:
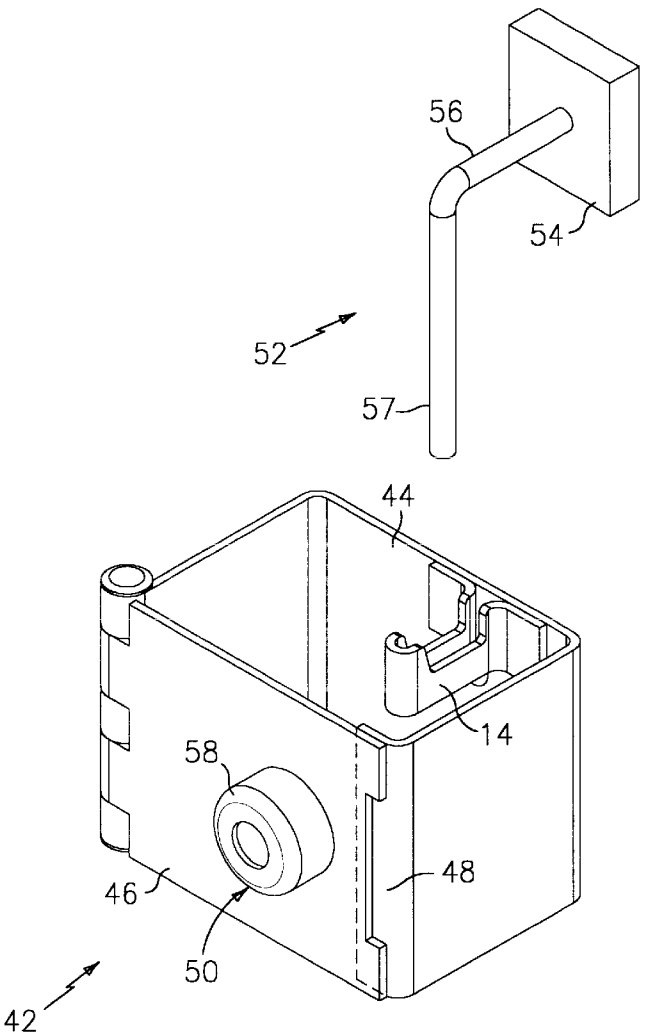
FIG. 4 is a perspective view of a second preferred embodiment of a wall-mounted locking system for firearms according to the present invention.

FIG. 4 shows a second preferred embodiment 40 of the wall-mounted locking system for firearms. An enclosure 42 of this embodiment comprises a U-shaped base plate 44 replacing the L-shaped base plate 12. A single door 46 (replacing the primary and secondary latch doors 16, 18) is connected to a first side end of the base plate 44 via a hinge. The breech hook 14 is attached to the base plate 44. Additionally, as shown in FIG. 4, the second side end of the base plate 44 is bent inwards at a right angle. This provides a flap 48 against which an end of the door 46 rests when closed. The flap 48 provides a surface behind which a lock mechanism 50 attached to the door 46 can engage when locked.

As also shown in FIG. 4, a muzzle hook 52 takes the place of the barrel ring 24. The muzzle hook 52 is a generally L-shaped metal rod comprising an offset portion 56 and a drop portion 57. The offset portion 56 of the muzzle hook 52 is mounted to a wall by itself (or to a wall-mounted plate 54) such that the drop portion 57 of the muzzle hook extends vertically downwards. To secure the firearm 26, the door 46 is swung outwards to open the enclosure 42. The firearm is first positioned so that the muzzle hook 52 extends into the firearm's muzzle, and is then positioned so that the breech hook 14 extends into and engages the firearm's breech. Then, the door 46 is swung against the flap 48 to close the enclosure 42, and the lock 50 is locked. The breech hook 14 and muzzle hook 52 act in unison to prevent the firearm from being vertically removed from the enclosure 42. Additionally, the muzzle hook 52 prevents the firearm's barrel from being moved laterally.

As with the key lock 20, it should be appreciated that many different types of lock mechanisms 50 could be used in the second preferred embodiment of the present invention. The exact configurations of such locks are not important, and further detail, therefore, is not provided herein. However, it should be noted that the lock mechanism 50 should securely lock the door 46 to the base plate 44, and it should be tamper proof, both from the outside (note that in FIGS. 4 and 5 the lock 50 is provided with a protective outer housing 58), and from the inside when a firearm 26 is held in the enclosure 42. Additionally, the lock 50 should be compact enough so that the enclosure 42 is not made unnecessarily large or bulky.

As an example, the lock mechanism 50 could be a key lock providing a selectively rotatable latch (not shown). When the lock was operated via a proper key, the latch would turn to rotate into place (or out of place) behind the flap 48. Alternatively, the lock could provide a moveable bolt that would extend into place (or out of place) behind the flap 48, or into a recess or other feature (not shown) disposed on the inner side of the base plate and dimensioned to accept the bolt. Furthermore, the lock could be configured to automatically lock when the door was moved to its closed position. Many different arrangements are possible.

Figure 5:
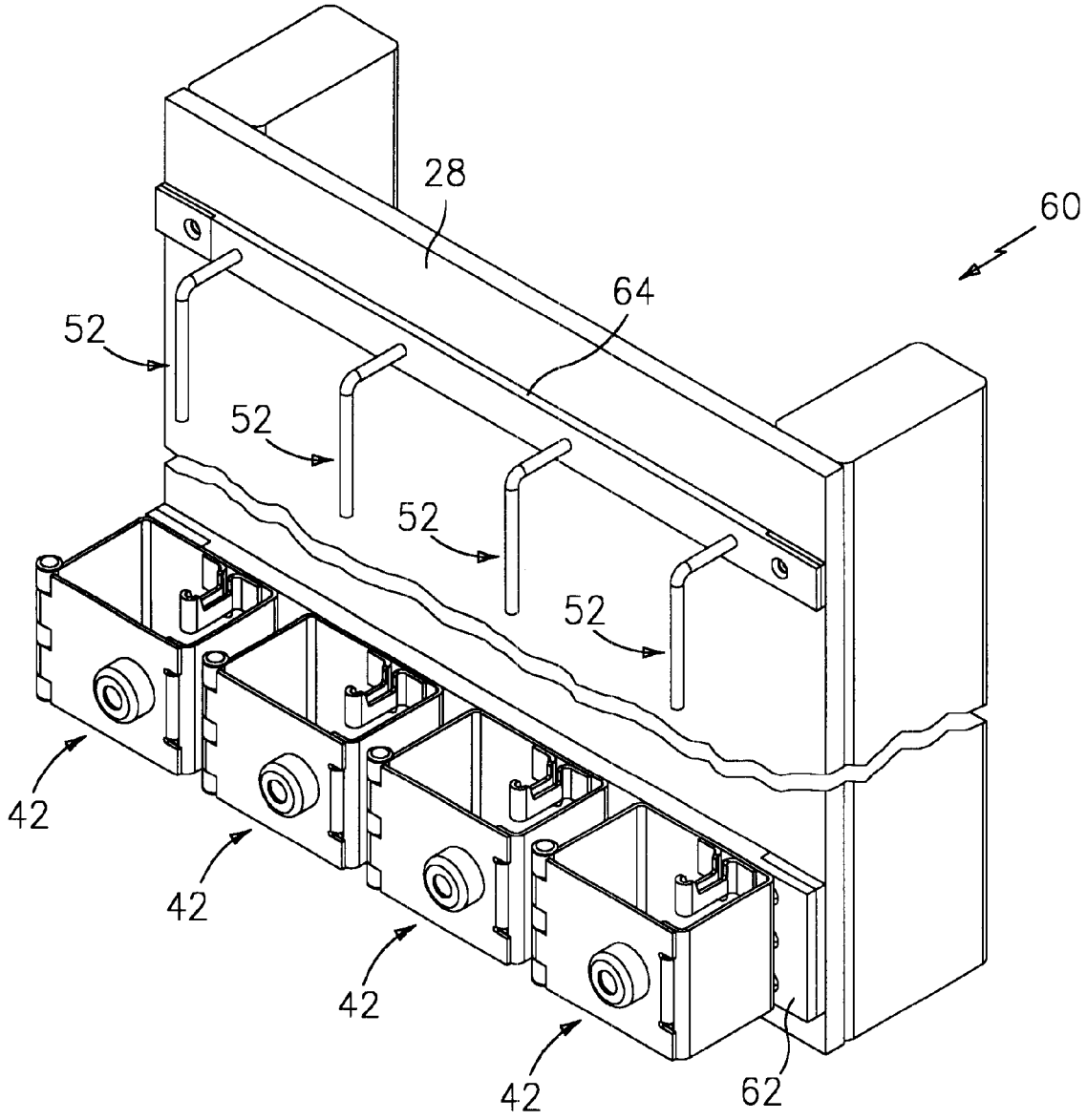
FIG. 5 is a perspective view of a third preferred embodiment of a wall-mounted locking system for firearms according to the present invention.

FIG. 5 shows a third preferred embodiment 60 of the present invention. Here, a plurality of enclosures 42 are attached, in a linear array-type fashion, to a first wall-mounted back plate 62. Additionally, a plurality of muzzle hooks 52 are mounted to a second wall-mounted back plate 64. The muzzle hooks 52 are spaced along the back plate 64 so that when the back plate 64 is properly affixed to the wall 28 above the array of enclosures 42, the muzzle hooks 52 and the enclosures 42 are aligned. Each of the enclosures 42 functions as described above with respect to FIG. 4.

The locking system array 60 can have many different configurations. For example, the muzzle hooks 52 can be attached directly to the wall 28 instead of to the second back plate 64. However, it must be remembered that the muzzle hooks or barrel rings have to be securely attached to the wall or other surface so that they do not come loose upon someone pulling on a firearm's barrel. Therefore, it is preferred that the muzzle hooks or barrel rings be attached to the second back plate 64, since this will more likely provide a secure and tamper-proof attachment.

Additionally, in the locking system array 60, barrel rings 24 can be used instead of muzzle hooks 52, and instead of having a plurality of individual enclosures 42, with each having separate side walls, the enclosures could have common side walls. This would make the array more compact. Also, instead of having single doors 46, the enclosures 42 could have dual hinged doors like those described above with respect to the first preferred embodiment 10 (FIGS. 1–3).

In the enclosure array 60, the plurality of enclosures 42 can have a common locking mechanism instead of individual locks for each enclosure. For example, each enclosure could be provided with dual doors having apertures and hasps as briefly described above. The hasps would be aligned so that a long locking bolt, rod, chain, cable or the like could be inserted through the hasps, with the bolt (or other element) being secured via a standard padlock or other lock (e.g., a cable lock).

Alternatively, the array of enclosures could be provided with a single long door attached to one of the enclosures and extending at least part-way along the array to cover all (or some) of the enclosures when in a closed position. In this configuration, the lock could be provided on the door, on the base plate where the door terminates, or the door could be provided with a perpendicular end extension flap (not shown) that would extend into a locking mechanism attached to the back plate.

The various wall-mounted components described herein are provided with conventional wall-mounting features (e.g., mounting holes). As should be appreciated by those of ordinary skill in the art, the wall-mounted components can be mounted to a wall in any conventional manner (e.g., screws, bolts, wall anchors), as long as the components are securely affixed to the wall.

Although the invention has been illustrated as primarily having metal parts (especially the enclosure), one of ordinary skill in the art will appreciate that the parts could be made from other materials, such as plastic, without departing from the spirit and scope of the invention.

Also, although the parts of the present invention have been illustrated as having certain shapes or configurations, one of ordinary skill in the art will appreciate that different configurations or interrelationships could be provided without departing from the spirit and scope of the invention. For example, the secondary door 18 could be L-shaped and attached to the base plate 12 like the primary door 16.

Additionally, although the preferred embodiments of the present invention have been illustrated as having breech hooks attached to the base plates, one of ordinary skill in the art will appreciate that the breech hooks could be attached to the side walls of the base plates or to the inner sides of the doors, without departing from the spirit and scope of the invention.

Furthermore, although the second preferred embodiment of the present invention has been illustrated as having a locking mechanism on the door, one of ordinary skill in the art will appreciate that the lock could be instead affixed to the second side end of the base plate without departing from the spirit and scope of the invention. In this version, instead of the second side end of the base plate being bent inwards to form a flap, the unhinged end of the door would be so configured.

Also, although the present invention has been illustrated as having the barrel ring or muzzle hook disposed above the enclosure, one of ordinary skill in the art will appreciate that the barrel ring or muzzle hook could be disposed below the enclosure, with the firearm being held therein with its barrel pointing vertically downwards, without departing from the spirit and scope of the invention. Furthermore, the locking system could be oriented horizontally, with the breech hook being configured and oriented with respect to the enclosure to effectively hold the firearm in a horizontal position.

Moreover, although firearm locking system of the present invention has been illustrated as being mounted to a wall, one of ordinary skill in the art will appreciate that the locking system could be affixed to other surfaces without departing from the spirit and scope of the invention.

Additionally, although the muzzle hook of the present invention has been illustrated as comprising a bent rod, one of ordinary skill in the art will appreciate that the muzzle hook could comprise a plurality of non-integral connected pieces without departing from the spirit and scope of the invention. For example, the offset portion of the muzzle hook could be a block or stand, with the drop portion comprising a rod extending down through (or out of) the block or stand.

Furthermore, although the firearm locking system of the present invention has been illustrated as having barrel rings or muzzle hooks with particular configurations, one of ordinary skill in the art will appreciate that further configurations could be provided without departing from the spirit and scope of the invention. For example, the barrel ring could be a hook, a sleeve, a hollow tube, or the like. Additionally, the muzzle hook could be a hollow cap or tube into which the end of the firearm's barrel would be inserted.

Also, although the present invention has been illustrated as having a barrel engagement means, one of ordinary skill in the art will appreciate that an enclosure with an attached breech hook could be provided by itself (not shown) without departing from the spirit and scope of the invention. Although this is not a preferred embodiment, it could be used in situations where less security is needed. As should be appreciated, the enclosure could be modified slightly to further support the firearm in the absence of the barrel engagement means.

Finally, although the wall-mounted locking system for firearms of the present invention has been illustrated as having a generally box-shaped enclosure, one of ordinary skill in the art will appreciate that any number of hinging members (doors) could be provided to accommodate the complex shapes of various long guns.

Since certain changes may be made in the above described wall-mounted locking system for firearms, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Having thus described the invention, what is claimed is:

1. A locking system for firearms comprising:

a. a mountable enclosure comprising:

i. a base plate attachable to a wall; and ii. a door pivotally attached to the base plate for creating an enclosure therewith when in a closed position;

b. a breech hook attached to the enclosure, said breech hook:

i. being hook-shaped, and configured to hold and support a firearm when the door is in the door's closed position and when the door is in an open position; and ii. being configured to extend into the firearm's ejection port and chamber, thereby preventing the firearm from being discharged and ammunition from being chambered, while allowing the firearm to remain loaded with ammunition;

c. locking means attached to the enclosure for facilitating selectively locking the door in the door's closed position; and d. a mountable barrel engagement means to be disposed along a longitudinal axis of the enclosure for limiting movement of a firearm's barrel; whereby, to secure the firearm, the firearm's barrel is positioned to be engaged by the barrel engagement means, the firearm is placed in the enclosure with the breech hook extending into the firearm's ejection port and chamber, and the door is closed and locked by the locking means.

2. The locking system of claim 1 wherein the breech hook is attached to the base plate.

3. The locking system of claim 1 wherein the locking means is attached to the door.

4. The locking system of claim 1 wherein:

a. the base plate is generally L-shaped and has first and second side ends; and b. the door comprises a generally L-shaped primary latch door attached to the first end of the base plate.

5. The locking system of claim 4 wherein:

a. the locking system further comprises a secondary latch door pivotally attached to the second end of the base plate;

b. the secondary latch door defines an aperture; and c. the locking means is attached to the primary latch door and is dimensioned to pass through the aperture.

6. The locking system of claim 1 wherein:

a. the base plate is generally U-shaped and has first and second side ends;

b. the door comprises a primary latch door pivotally attached to the first end of the base plate;

c. the locking system further comprises a secondary latch door pivotally attached to the second end of the base plate;

d. the secondary latch door defines an aperture; and e. the locking means is attached to the primary latch door and is dimensioned to pass through the aperture.

7. The locking system of claim 1 wherein:

a. the base plate is generally U-shaped and has first and second side ends; and b. the door is pivotally attached to the first side end of the base plate and is dimensioned to come into contact with the second side end of the base plate when in the door's closed position.

8. The locking system of claim 1 wherein the barrel engagement means is a barrel ring defining an aperture dimensioned to accept the firearm barrel.

9. The locking system of claim 1 wherein the barrel engagement means is a muzzle hook dimensioned to be at least partially inserted in a firearm muzzle.

10. The locking system of claim 9 wherein the muzzle hook comprises:

a. an offset portion; and b. a drop portion connected to the offset portion at substantially a 90° angle.

11. The locking system of claim 10 wherein the muzzle hook comprises a rod bent at substantially a 90° angle.

12. A locking system for firearms comprising:

a. a mountable enclosure comprising:

i. a base plate; and ii. a door pivotally attached to the base plate and dimensioned to create an enclosure therewith when in a closed position;

b. a breech hook attached to the enclosure, said breech hook:

i. being hook-shaped, and configured to hold and support a firearm when the door is in the door's closed position and when the door is in an open position; and ii. being configured to extend into the firearm's ejection port and chamber, thereby preventing the firearm from being discharged and ammunition from being chambered, while allowing the firearm to remain loaded with ammunition;

c. a lock attached to the enclosure, wherein the lock is configured to selectively hold the door in the door's closed position; and d. a mountable barrel ring defining an aperture dimensioned to accept a firearm barrel, wherein the barrel ring is to be disposed along a longitudinal axis of the enclosure; whereby, to secure the firearm, the firearm's barrel is inserted through the barrel ring's aperture, the firearm is placed in the enclosure with the breech hook extending into the firearm's ejection port and chamber, and the door is closed and locked by the lock.

13. A locking system for firearms comprising:

a. a mountable enclosure comprising:

i. a base plate; and ii. a door pivotally attached to the base plate and dimensioned to create an enclosure therewith when in a closed position;

b. a breech hook attached to the enclosure, said breech hook:

i. being hook-shaped, and configured to hold and support a firearm when the door is in the door's closed position and when the door is in an open position; and ii. being configured to extend into the firearm's ejection port and chamber, thereby preventing the firearm from being discharged and ammunition from being chambered, while allowing the firearm to remain loaded with ammunition;

c. a lock attached to the enclosure, wherein the lock is configured to selectively hold the door in the door's closed position; and d. a mountable muzzle hook dimensioned to be at least partially inserted in the firearm's muzzle, wherein the muzzle hook is to be disposed along a longitudinal axis of the enclosure; whereby, to secure the firearm, the firearm's barrel is positioned so that the muzzle hooks enters into the firearm's muzzle, the firearm is placed in the enclosure with the breech hook extending into the firearm's ejection port and chamber, and the door is closed and locked by the lock.

14. A locking system for firearms comprising:

a. a lockable enclosure configured to selectively prevent a firearm longitudinally passing through the enclosure from being removed from the enclosure in a radial direction; and b. support means attached to the enclosure for preventing the firearm from being removed from the enclosure in a longitudinal direction, said support means comprising a breech hook, wherein:

i. the breech hook is hook-shaped, and is configured to hold and support the firearm; and ii. the breech hook is configured to extend into the firearm's ejection port and chamber, thereby preventing the firearm from being discharged and ammunition from being chambered, while allowing the firearm to remain loaded with ammunition.

15. The locking system of claim 14 further comprising barrel engagement means longitudinally aligned with the enclosure for inhibiting movement of the firearm's barrel.

16. A locking system for firearms comprising:

a. a lockable enclosure; and b. a breech hook attached to the lockable enclosure, wherein the breech hook:

i. is hook-shaped, and is configured to hold and support the firearm; and ii. is configured to extend into the firearm's ejection port and chamber, thereby preventing the firearm from being discharged and ammunition from being chambered, while allowing the firearm to remain loaded with ammunition.

17. A locking system for firearms comprising:

a. an enclosure configured to be selectively locked into place around a firearm; and b. a breech hook attached to the enclosure:

i. is hook-shaped, and is configured to hold and support the firearm; and ii. is configured to extend into the firearm's ejection port and chamber, thereby preventing the firearm from being longitudinally removed from the enclosure and preventing the firearm from being discharged and ammunition from being chambered, while allowing the firearm to remain loaded with ammunition.

18. The locking system of claim 17 further comprising barrel engagement means longitudinally aligned with the enclosure for limiting movement of the firearm's barrel.

19. A locking system for firearms comprising:

a. a plurality of enclosures attached to a first back plate, wherein each enclosure comprises:

i. a base plate; and ii. a door pivotally attached to the base plate for creating an enclosure therewith when in a closed position;

b. a plurality of breech hooks each attached to a respective one of the enclosures, wherein each of the breech hooks:

i. is hook-shaped, and is configured to hold and support a firearm when the respective enclosure's door is in the door's closed position and when the door is in an open position; and ii. is configured to extend into a firearm's ejection port and chamber, thereby preventing the firearm from being discharged and ammunition from being chambered, while allowing the firearm to remain loaded with ammunition;

c. a plurality of locks each attached to a respective one of the enclosures, wherein each lock is configured to selectively hold its respective enclosure's door in the door's closed position; and d. a plurality of barrel engagement means each associated with a respective one of the enclosures for limiting movement of the barrels of firearms held in the enclosures; whereby each enclosure and associated barrel engagement means secures a firearm by way of the firearm's barrel being positioned to be engaged by the barrel engagement means, the firearm being placed in the enclosure with the enclosure's respective breech hook extending into the firearm's ejection port and chamber, and the door being closed and locked by the enclosure's respective lock.

20. The locking system of claim 19 wherein the plurality of barrel engagement means are attached to a second back plate.

21. The locking system of claim 19 wherein:

a. each base plate is generally U-shaped and has first and second side ends;

b. each door comprises a primary latch door pivotally attached to the first end of the base plate;

c. each enclosure further comprises a secondary latch door pivotally attached to the second end of the base plate;

d. each secondary latch door defines an aperture; and e. each lock is attached to the lock's respective enclosure's primary latch door and is dimensioned to pass through the aperture of the lock's respective enclosure's secondary latch door.

22. The locking system of claim 19 wherein for each enclosure:

a. the base plate is generally U-shaped and has first and second side ends; and b. the door is pivotally attached to the first side end of the base plate and is dimensioned to come into contact with the second side end of the base plate when in its closed position.

23. The locking system of claim 19 wherein each barrel engagement means is a barrel ring defining an aperture dimensioned to accept the firearm barrel.

24. The locking system of claim 19 wherein each barrel engagement means is a muzzle hook dimensioned to be at least partially insertable in a firearm muzzle.

25. A locking system for firearms comprising:

a. an enclosure array comprising:

i. a plurality of U-shaped cells each defining a longitudinal through space and having a side opening, wherein the longitudinal through-space and the side opening are dimensioned to accommodate a firearm; and ii. a door pivotally affixed to one of the cells and dimensioned to cover the side opening of at least one of the U-shaped cells when in a closed position, whereby firearms held in the cells so covered are prevented from being removed through the side openings;

b. a breech hook attached to the enclosure array, said breech hook:

i. being hook-shaped, and configured to hold and support a firearm when the door is in the door's closed position and when the door is in an open position; and ii. being configured to extend into the firearm's ejection port and chamber, thereby preventing the firearm from being discharged and ammunition from being chambered, while allowing the firearm to remain loaded with ammunition;

c. locking means attached to the enclosure array for selectively locking the door in the door's closed position; and d. a barrel engagement means longitudinally aligned with the breech hook for limiting movement of the barrel of the firearm when held and supported by the breech hook.

26. The locking system of claim 25 wherein the plurality of U-shaped cells comprises:

a. a base plate; and b. a plurality of side walls attached to and extending perpendicularly away from the base plate to form the U-shaped cells.

27. The locking system of claim 25 wherein the plurality of U-shaped cells comprises:

a. a back plate; and b. a plurality of U-shaped base plates attached to the back plate.

28. A method of securing a firearm comprising the steps of:

a. preventing the firearm from being moved in a longitudinal direction by engaging the firearm's breech with a breech hook, wherein the breech hook:

i. is hook-shaped, and is configured to hold and support the firearm; and ii. is configured to extend into the firearm's ejection port and chamber, thereby preventing the firearm from being discharged and ammunition from being chambered, while allowing the firearm to remain loaded with ammunition;

b. preventing the firearm from being disengaged from the breech hook and from being moved in a radial direction by locking an enclosure attached to the breech hook around the firearm; and c. limiting radial movement of the firearm's barrel.

29. The method of claim 28 wherein step c is performed by inserting the barrel through a barrel ring.

30. The method of claim 28 wherein step c is performed by inserting a muzzle hook into the firearm's muzzle.

31. A method of securing a firearm comprising the steps of:

a. preventing the firearm from being discharged and ammunition from being chambered, while allowing the firearm to remain loaded with ammunition, by engaging the firearm's breech with a breech hook that extends into the firearm's ejection portion and chamber, said breech hook being hook-shaped to hold and support the firearm; and b. preventing the firearm from being disengaged from the breech hook by locking an enclosure attached to the breech hook around the firearm.

32. The method of claim 31 further comprising the step of limiting radial movement of the firearm's barrel.

* * * * *